United States Patent [19]

Graham

[11] Patent Number: 4,884,802

[45] Date of Patent: Dec. 5, 1989

[54] EXERCISE APPARATUS ADJUSTABLE DURING USE

[76] Inventor: Gary A. Graham, P.O. Box 2000, Glacier, Wash. 98244

[21] Appl. No.: 268,877

[22] Filed: Nov. 8, 1988

[51] Int. Cl.[4] ..... A63B 21/00

[52] U.S. Cl. ..... 272/136; 272/120; 272/127; 272/128; 272/72

[58] Field of Search ..... 272/72, 120, 121, 134, 272/144, 127, 128, 142, 135, 136, DIG. 4; 128/25 R

[56] References Cited

U.S. PATENT DOCUMENTS

| | | | |
|---|---|---|---|
| 1,950,174 | 3/1934 | Harrison | 272/134 |
| 3,563,542 | 2/1971 | Wellman et al. | 272/135 |
| 3,586,322 | 6/1971 | Kverneland | 272/120 |
| 3,770,267 | 11/1973 | McCarthy | 272/72 |
| 3,876,198 | 4/1975 | Seligman | 272/142 |
| 4,272,074 | 6/1981 | Sferle | 272/120 |
| 4,463,945 | 8/1984 | Spector | 272/72 |
| 4,706,953 | 11/1987 | Graham | 272/120 |

FOREIGN PATENT DOCUMENTS

| | | | |
|---|---|---|---|
| 469155 | 12/1928 | Fed. Rep. of Germany | 272/72 |
| 2407907 | 8/1975 | Fed. Rep. of Germany | 272/134 |
| 667083 | 9/1964 | Italy | 272/72 |

*Primary Examiner*—Richard J. Apley
*Assistant Examiner*—J. Welsh
*Attorney, Agent, or Firm*—Robert W. Jenny

[57] ABSTRACT

The apparatus comprises a carriage supported on a track assembly by rollers. Energy absorption and release apparatus biases the carriage toward an at-rest position approximately midway between the ends of the track assembly. The user lies back-down on the carriage and, using handles and a foot rest provided for the purpose, sets the carriage into reciprocating motion. The effort used in causing the motion and the acceleration forces experienced as a result of it provide effects beneficial to the user's voluntary muscles, skeletal muscles and internal organs. The energy absorption and release apparatus comprises primary and secondary apparatuses. The forces and energy levels involved in the operation of both the primary and secondary apparatuses is adjustable while the apparatus is in use, the secondary apparatus being adjustable by the user. The adjustments are effected by manual engagement and disengagement of units of sets of bungee apparatus incorporated in the primary and secondary energy storage and release apparatuses.

3 Claims, 5 Drawing Sheets

FIG. 5
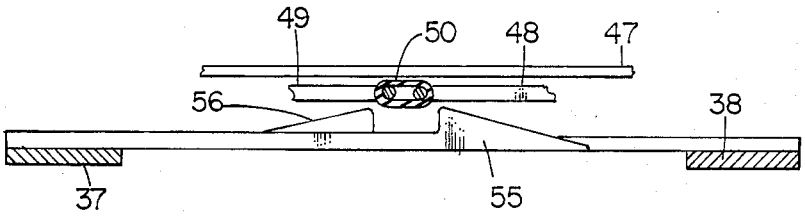
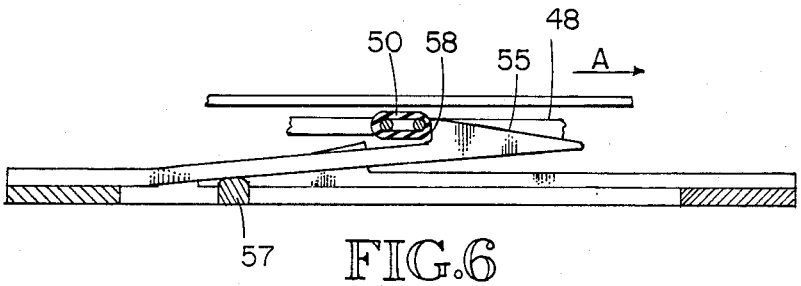
FIG. 6
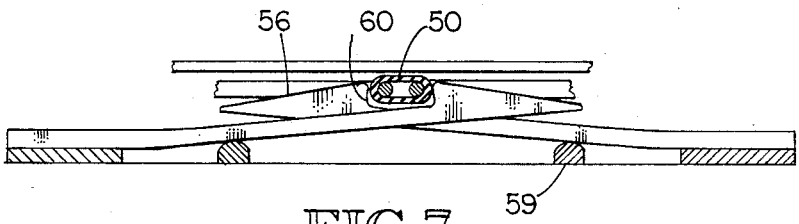
FIG. 7
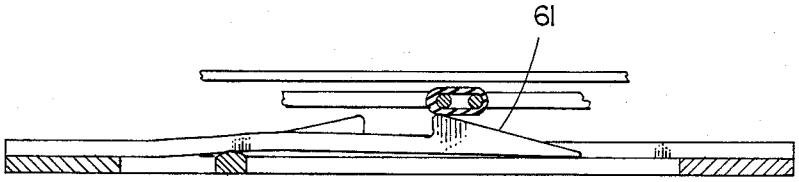
FIG. 8

FIG. 9
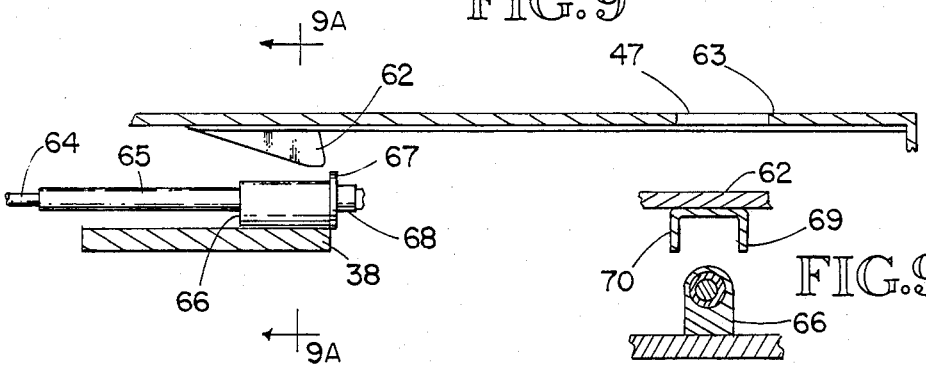
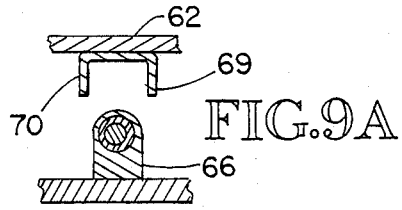
FIG. 9A
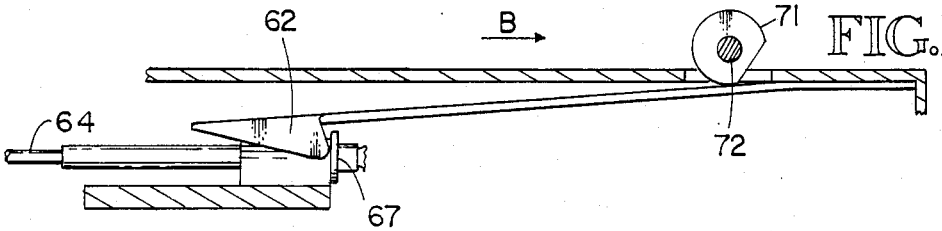
FIG. 10
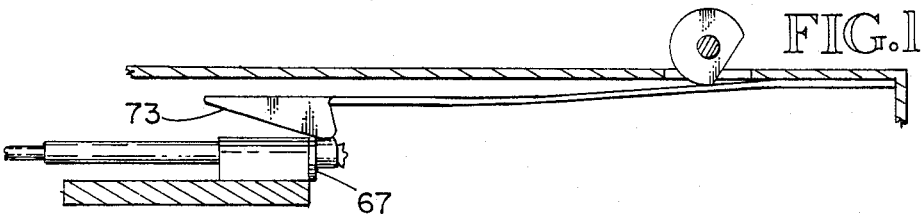
FIG. 11
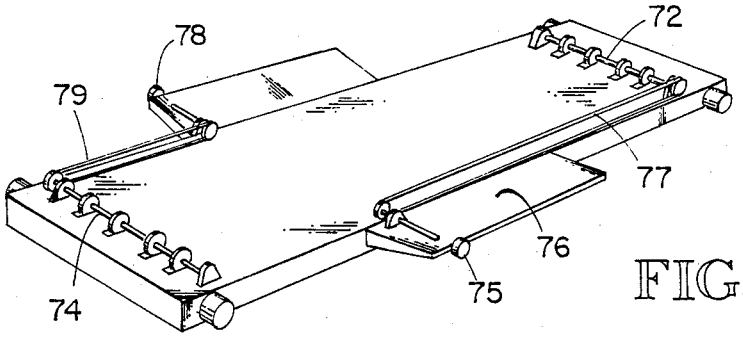
FIG. 12

FIG. 13
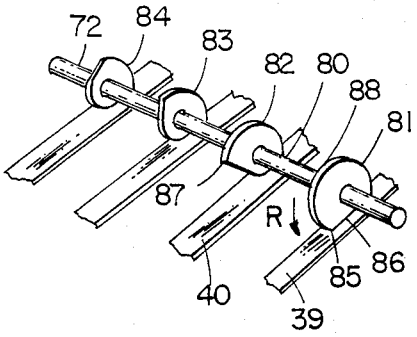
FIG. 14
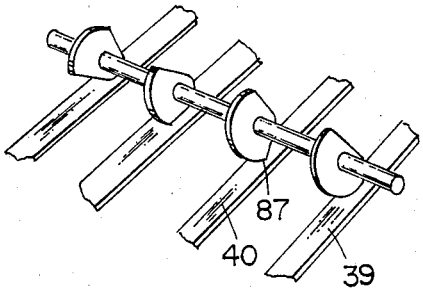
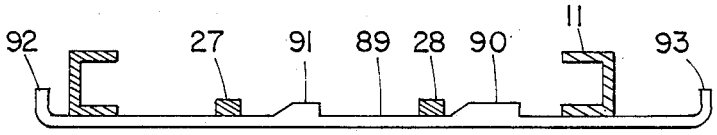
FIG. 15
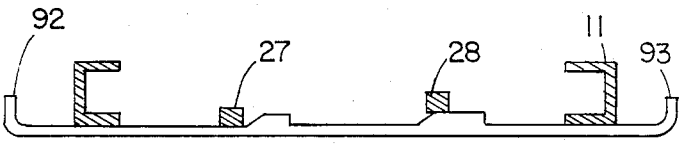
FIG. 15A
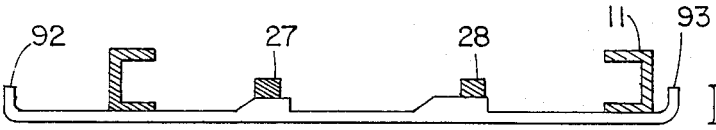
FIG. 15B
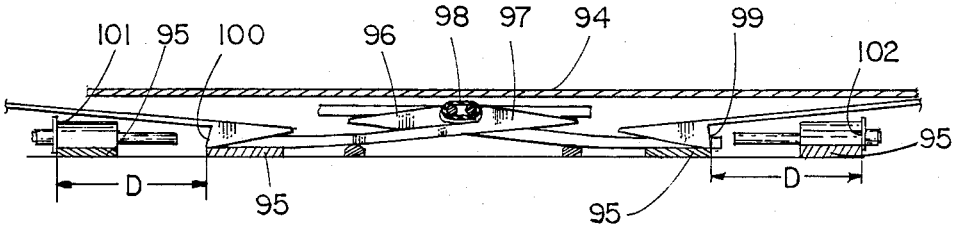
FIG. 16

EXERCISE APPARATUS ADJUSTABLE DURING USE

BACKGROUND OF THE INVENTION

1. Field of the Invention

The subject invention is in the field of exercise apparatus. More specifically it is in the field of such apparatus for exercising internal organs and skeletal muscle groups along with exercise of virtually all voluntarily controlled muscles. Still more particularly the apparatus is in the field of art related to exercise in which the exercising person provides all the input energy at whatever level judged to be appropriate. Further, the invention is in the field of such apparatus which accomodates the user in a supine position.

2. Prior Art

Prior art in this field is profuse, ranging from cradles, swings, rocking chairs, rocking horses, pogo sticks, trampolines and the like, to the rocking tables used in hospitals and other care centers for exercising invalids and the apparatus designed to provide exercise for people in zero gravity environment in space travel. The inventor was involved in the design, development and testing of space oriented exercise apparatus with the Boeing Company, Aerospace Division in 1963. (Aerospace Medicine, December 1966 "Independence of Changes In Functional and Performance Capacities Attending Prolonged Bed Rest.") The related art found in a preliminary search of the art is listed here. U.S. Pat. Nos. 1,750,549 Thomson et al.; 3,586,322 Kverneland;

2,841,139 Tarr; 3,770,267 McCarthy;

3,164,150 Reid; 4,149,713 McLeod;

4,198,045 Miller;

Further arts, includes a German patent, No. 469,155 by Raihofer, U.S. Pat. No. 3,770,267 by McCarthy and U.S. Pat. No. 4,101,124 by Maknke. However, the closest and most pertinent prior art is found in U.S. Pat. No. 4,706,953 issued to the subject inventor, U.S. patent application Ser. No. 083,044 by the subject inventor and U.S. Pat. No. 4,775,150 issued to the subject inventor. All the examples in the prior art provide passive and/or active exercise of various types and degrees with various means and techniques for adjusting and/or controlling the various characteristics of the exercises. All the various kinds and types of apparatus and equipment can be compared in terms of cost, space requirements, effectiveness, versatility, serviceability, utility and other factors, including environmental effects such as noise.

In spite of the profuseness of the prior art, apparatus providing certain attributes, either generally desirable or desirable under certain circumstances was not available until provided by the inventions by the subject inventor.

One attribute is that the apparatus offers essentially equivalent effects in both the foot-to-head and head-to-foot directions. Another attribute is that the person exercising be subjected to forces parallel to the spinal column with the forces ranging from less than the person's weight to more than the person's weight or, in more technical terminology, less than the force of gravity to more than the force of gravity, usually expressed in terms of g, the acceleration of gravity: less than 1 g to more than 1 g. This attribute is enhanced when the magnitudes of the forces in the foot-to-head direction are independently controllable relative to the magnitudes of the forces in the head-to-foot direction.

Another attribute is that the exercise is primarily for the purposes of relaxation, cardiovascular stimulation and toning as different from exercise primarily for developing strength.

In the apparatus in six of the prior art patents the user is or may be prone, these being U.S. Pat. Nos. 2,841,139, 3,164,150, 4,101,124, 4,198,045, 4,272,074, and German patent No. 469,155. Of these various patented concepts, that of Raihofer is the only one which offers the attribute of essentially equivalent effects in both the foot-to-head and head-to-foot directions. Several of the concepts offer the attribute of exercise with feet and legs variable or optional. None offer the specific attributes of (1) controlled forces ranging from less than the force of gravity to more than the force of gravity, (2) having the magnitudes of head-to-foot direction forces be independently controllable related to the magnitudes of foot-to-head direction forces and (3) providing exercise primarily for the purposes of cardiovascular stimulation and toning as different from exercise primarily for developing muscle strength.

The subject invention provides exercise apparatus in which the person exercising or being exercised is subjected to forces in directions essentially parallel to the backbone and from head toward foot and foot toward head with the magnitudes of the forces controllable in the range from a fraction of the force of gravity to multiples of the force of gravity. The forces in the direction from foot to head are independently controllable relative to the magnitude of the forces in the direction from head to foot. The apparatus also provides exercise primarily for the purpose of cardiovascular stimulation and toning.

SUMMARY OF THE INVENTION

The present invention is an exercise apparatus comprising basically a platform accomodating the user and moveable back and forth along a track assembly with means biasing the platform to a position of rest intermediate of the limits of the motion. The track assembly is essentially horizontal and rectilinear. The user lies supine on the platform. Using appropriate supports, guides, restraints, etc., the user and platform are put into reciprocating motion on the track assembly. The energy for the motion is provided by the user. In reciprocating motion the masses of the user and platform are accelerated in one direction, such as foot to head; then the masses are decelerated, stopped and accelerated in the other direction, heat to foot, to be decelerated, stopped and again accelerated in the first direction with the cycle repeating as many times as needed or desired. As is well known, the accelerations and decelerations (or positive and negative accelerations) produce inertial forces on the user's body and all its parts. When the acceleration rate is 32.2 feet per second squared (32.2 ft/sec$^2$) the inertial force is equal to the force of gravity and is equal to the person's weight. As these forces are applied, the skeletal muscles, tissues, etc. of the person's body are called upon to perform their various functions in maintaining the shape, formation and integrity of the body and are thus exercised. In particular, the cardiovascular system is stimulated. In addition those elements of the user's body used in causing and/or controlling the motion are also exercised.

The motions of the platform and user on it are influenced and limited by energy storage and release means, termed energy means for the purposes of this disclosure. The characteristics of these means are adjustable.

It has been found in the use of the apparatus that it would be advantageous to have the apparatus adjustable while it is in use, adjustable in terms of the levels of the forces and the amounts of energy stored and released in the cyclical operation of the apparatus. Therefore it is an objective of the subject invention to provide exercise apparatus of the subject type in which the forces and associated energy levels involved in the operation can be adjusted by the user while the apparatus is in use.

There are two energy means, the primary and secondary. The primary means is effective for any motion of the carriage from its at-rest position. The secondary means supplements the primary by becoming effective after the carriage has moved specific distances in either direction from its at-rest position.

The primary energy means is permanently attached to the carriage and is disengageably engaged with the track assembly. The secondary energy means is permanently attached to the track assembly and is disengageably engaged with the carriage. Both primary and secondary energy means can be engaged to function in only the foot-to-head direction, only the head-to-foot direction or both directions. The engagements of the primary energy means are controlled by mechanism installed in the track assembly. The engagements of the secondary energy means are controlled by mechanism installed on the carriage and accessible to and usable by the user while the apparatus is in use.

The primary energy means comprises two sets of bungee cords, engageable independently in either or both directions. The secondary energy means comprises four bungee cord sets, also engageable independently and in either or both directions.

The primary energy means comprises flexible hooks which are attached to the track assembly and, in their at-rest condition, do not engage the bungee cords attached to the carriage. The hooks are deflected by manually operated cams to cause them to engage the bungee cords and thus engage the primary energy means. The hooks incorporate cam surfaces such that if the hooks are deflected for engagement and are not correctly indexed relative to the bungee cord assembly for engagement, the cam surfaces cause the hooks to override the bungee cords until the hooks and cords are correctly indexed.

The secondary energy system is similar in all these respects to the primary energy system. However, the cam means for deflecting the springs to cause engagement is installed on the carriage and interconnected to control knobs accessible to a user in place on the carriage so that the effectiveness of the secondary energy system can be adjusted by the user while the apparatus is in use.

The apparatus is described in more detail below with reference to the attached drawings.

BRIEF DESCRIPTION OF THE DRAWINGS

FIG. 5 schematically illustrates the primary means disengaged.

FIG. 6 schematically illustrates the primary energy means engaged for function in one direction only.

FIG. 7 schematically illustrates the primary energy means engaged for function in two directions.

FIG. 8 schematically illustrates the primary energy means accomodating an engagement made when the carriage was not in its at-rest position.

FIG. 9 schematically illustrates the secondary means disengaged.

FIG. 9A is a sectional view taken at 9—9 in FIG. 9 and shows catch details.

FIG. 10 schematically illustrates the secondary energy means engaged for function in one direction only.

FIG. 11 schematically illustrates the secondary energy means accomodating an engagement made when the carriage was not in its at-rest position.

FIG. 12 schematically illustrates the apparatus for control by the user of the engagement/disengagement of the secondary energy means.

FIG. 13 shows schematic details of the camming for engagement/disengagement of the secondary energy means with no engagement.

FIG. 14 shows schematic details of the camming for engagement/disengagement of the secondary energy means with the cam adjusted to engage two of the four secondary energy means.

FIGS. 15, 15A and 15B shows schematic details of the camming for engagement/disengagement of the primary energy means with no engagement.

FIG. 16 illustrates the engagement relationships of the primary and secondary energy means.

DETAILED DESCRIPTION OF THE INVENTION

Figure 1:
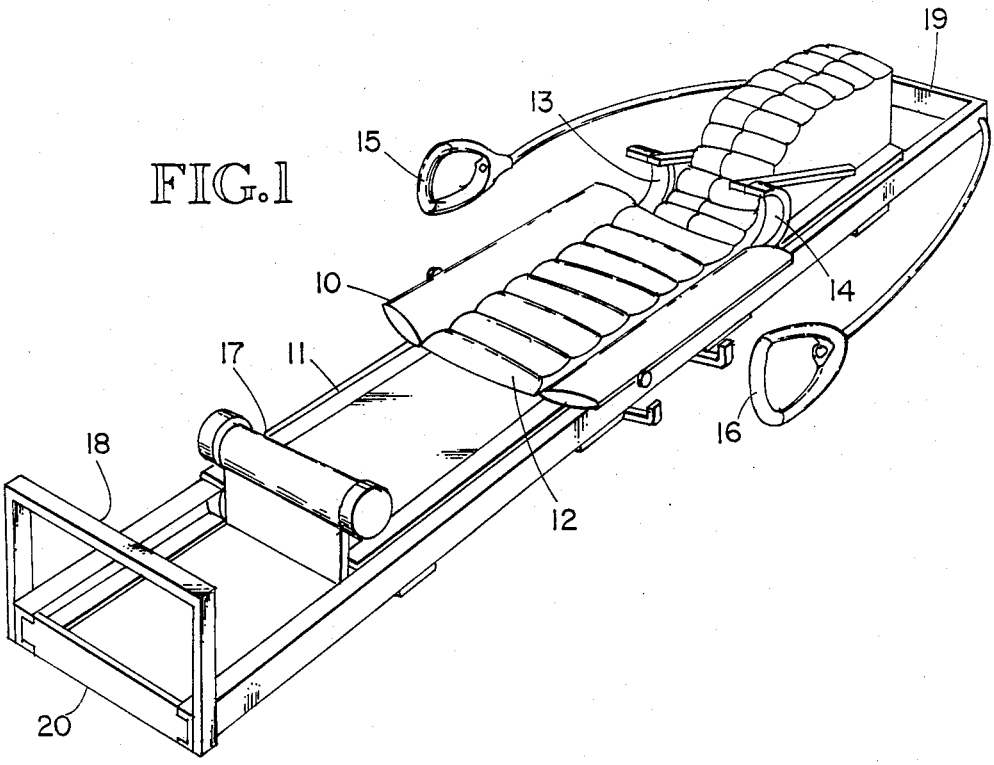
FIG. 1 is a perspective view of the apparatus.

The subject apparatus 10 is shown in FIG. 1, comprising a track assembly 11 and a carriage 12 installed in the track assembly on rollers so that the carriage can move from end to end of the track assembly. A user lies back down, e.g. in the supine position, on the carriage, shoulders engaging straps 13 and 14, hands gripping handles 15 and 16 and feet on rest 17 or rest 18 as desired. The carriage and track assembly are interconnected by energy storage and release means, herinafter referred to as energy means, which bias the carriage to an at-rest position generally midway between the ends of the track assembly and produce forces tending to return the carriage to that position whenever it is displaced from that position.

In use the user pulls on the grips and/or pushes on rest 18 to displace the carriage toward the head end 19 of the apparatus and then relaxes to allow th energy means to decelerate the motion toward the head end, stop the carriage and user and then accelerate them into motion toward the food end 20 of the track assembly. This motion is then decelerated, stopped and reversed by the energy means and/or action of the user's hands and/or feet. The resulting reciprocating motion of the carriage provides beneficial exercise and other effects for the user.

Figure 2:
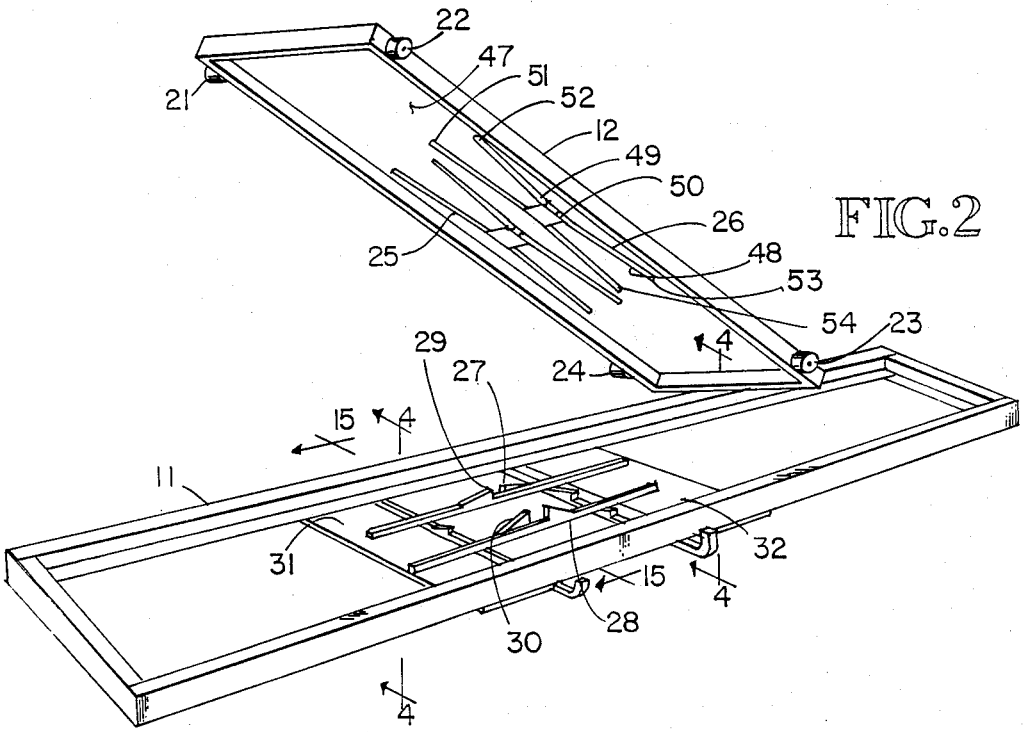
FIG. 2 is a semi-schematic, exploded perspective view of the apparatus illustrating the primary energy means.

The carriage and track assembly are shown schematically in FIG. 2 which illustrates the part of the energy means termed the primary energy means. Carriage 12 is supported in track assembly 11 on rollers 21, 22, 23 and 24. The primary energy means comprises bungee cord assemblies 25 and 26 attached to the carriage and catches 27, 28, 29 and 30 attached to crossmembers 31 and 32 of the track assembly. The action of the primary means is discussed in detail below.

Figure 3:
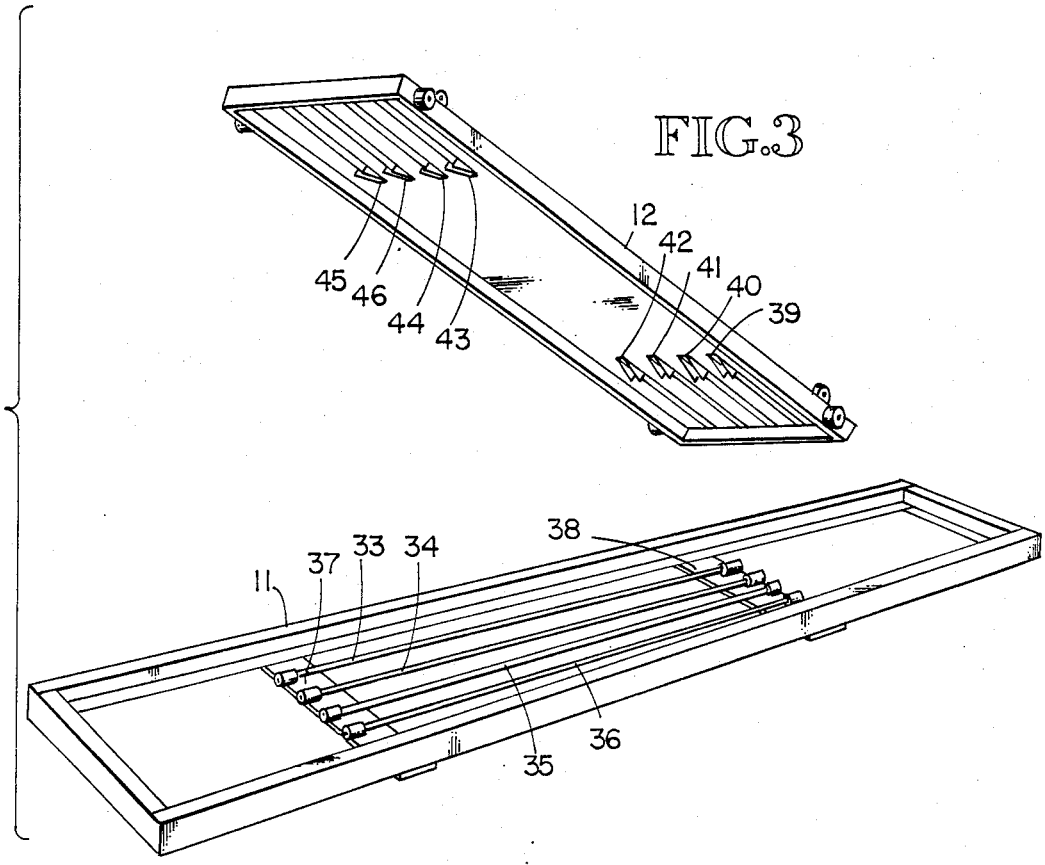
FIG. 3 is a semi-schematic, exploded perspective view of the apparatus illustrating the secondary energy means.

FIG. 3 illustrates a second part of the energy means, termed the secondary energy means. The secondary energy means comprises bungee assemblies 33, 34, 35 and 36 attached to crossmembers 37 and 38 on the track assembly and catches 39, 40, 41, 42, 43, 44, 45 and 46 attached to the carriage. The action of the secondary energy means is also described in detail below.

Figure 4:
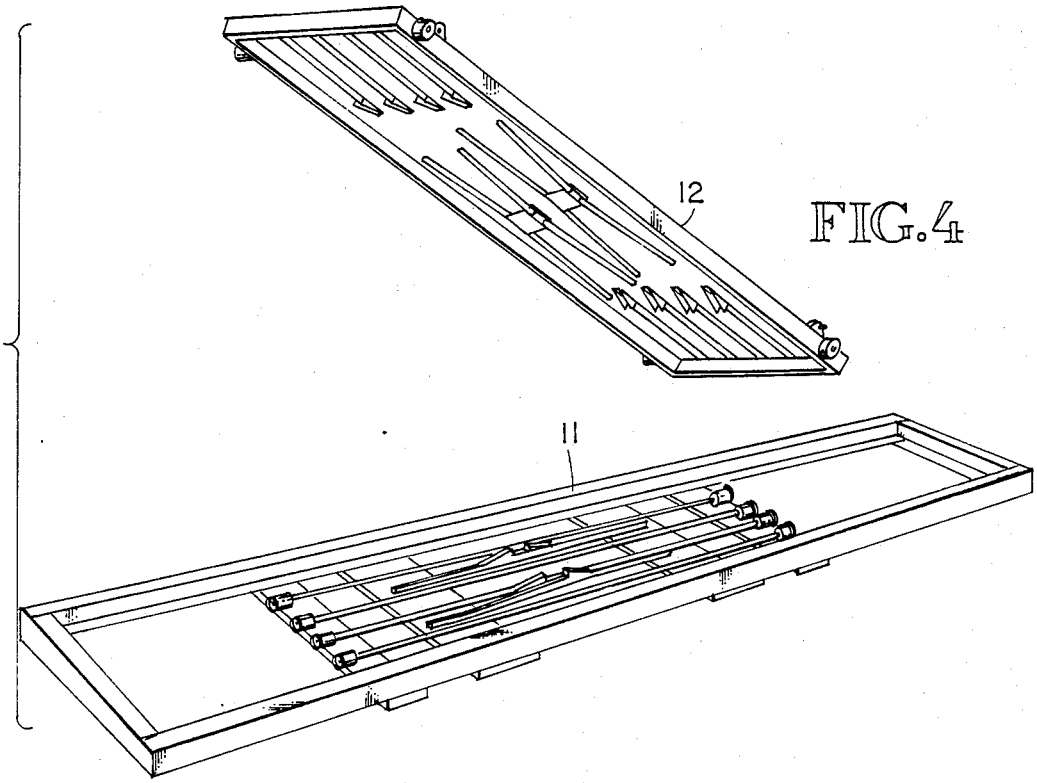
FIG. 4 is a semi-schematic, exploded perspective view of the apparatus illustrating both energy means in place.

FIG. 4 schematically illustrates the apparatus with both the primary and secondary energy means installed, showing their relative positioning.

FIG. 5 is a schematic elevational, sectional view of the basic elements of the primary energy means taken at 4—4 in FIG. 2. Structure 47 is the support surface of the carriage. Bungee cords 48 and 49 are passed through loop 50 and attached to structure 47 at points 51, 52 53 and 54 (FIG. 2). Catch 55 is attached to crossmember 37 and catch 58 is attached to crossmember 38. This apparatus is shown in this view in the disengaged condition. The carriage can move along the track without being influenced by the primary energy means.

In FIG. 6 catch 55 has been deflected by cam 57 so that catch surface 58 engages loop 50. In this condition motion of the carriage in the direction indicated by arrow A will be influenced by tension forces in cord 48.

In FIG. 7 catch 56 has been deflected by cam 59 so that surface 60 also engages loop 50. In this condition motion of the carriage in either direction will be influenced by forces in the bungee cords and the primary energy means is holding the carriage in its at-rest position.

Referring to FIG. 8, in the event that cam 57 or 59 is activated to deflect its associated catch when loop 50 is out of position for engagement, loop 50, in moving toward the position for engagement, will contact surface 61 and cam the catch out of its way to allow it to reach the engagement position.

FIGS. 9, 10 and 11 schematically illustrate details of the secondary energy means, the view being taken at 9—9 in FIG. 3. Catch 62 is attached near its end 63 to carriage surface structure 47. Bungee cord 64 extends through sleeve 65 which slides in a hole in support 66 attached to crossmember 38 and comprises flange 67. The cord is retained in the sleeve by ferrule 68. The apparatus is shown in the disengaged condition in this view.

As shown in FIG. 9A a sectional view of catch 62 taken at 9—9 in FIG. 9, catch 62 has cam flanges 69 and 70 which move past support 66. In FIG. 10 catch 62 has been deflected so that flanges 69 and 70 engage flange 67. With this engagement motion of the carriage in the direction of arrow B will be influenced by forces in cord 64. Catch 62 is deflected by cam 71 of cam assembly 72, described in more detail below.

In the event that catch 62 is deflected when out of position range for engagement of the flange, edge(s) 73 will engage the flange 67 and cam the catch over the flange, as shown in FIG. 11.

FIG. 12 is a schematic, perspective top view of the carriage showing the cam assemblies 72 and 74 for controlling the engagement of the secondary energy means. Assembly 72 is actuated by control knob 75 in arm rest 76 via chain drive 77. Assembly 74 is actuated by knob 78 via chain drive 79, each chain drive comprising appropriate chains and sprockets and the knob and cam assemblies are supported on appropriate shafts and bearings, all well within the art.

FIG. 13 illustrates cam assembly 72 in more detail. Its basic essentials are shaft 80 and cams 81, 82, 83 and 84. Each cam contacts a catch and in FIG. 13 all the catches are in the disengaged condition. Each cam has a low dwell and a high dwell. When the low dwell of a cam is contacting the associated catch, the catch is in the disengaged condition. When a cam has been rotated so that its lobe or high dwell is contacting the associated catch, the catch is in the engaged condition. Lobe 85 on cam 81 is N degrees from a perpendicular to low dwell 86 so that turning the cam assembly N degrees in the direction of arrow R will engage lobe 85 with catch 39 and put it into the engaged condition. Lobe 87 on cam 82 is N degrees behind lobe 85 so that turning the cam assembly another N degrees in the direction of arrow R will put lobe 87 into contact with catch 40, putting it into the engaged condition while high dwell 88 on cam 81 maintains catch 39 in that condition. It can be understood from this description that the cam assembly has five settings, ranging from no catches in engagement condition to all four catches in the engagement condition. In FIG. 14, the cam is set so that catches 39 and 40 are in the engagement condition.

FIGS. 15, 15A and 15B illustrate the control of the engagement and disengagement of the catches of the primary energy system. The FIGS. are sectional views taken at 15—15 in FIG. 2. Bar cam 89 has lobes 90 and 91 which engage catches 27 and 28 when the cam is moved in the direction indicated by arrow C. In FIG. 15A catch 28 has been deflected into the engagement condition and in FIG. 15B both catches have been so deflected. There is a cam for both sets of primary system catches. The bar cam can be operated from either end and using tabs 92 and 93.

FIG. 16 is a schematic diagram showing the relative disposition of the primary and secondary energy systems, both shown in the engaged condition. It can be understood from the diagram that the primary system is involved for any motion of carriage 94 or track assembly 95 since the primary system catches 96 and 97 are in direct contact with loop 98 of the primary bungee apparatus. It can also be understood that the secondary energy systems is not involved until the carriage has moved distance D in either direction bring secondary system catches 98 or 99 into contact with flanges 101 or 102 respectively of the secondary bungee apparatus previously described.

It will be understood at this point that the apparatus described enables adjustment of the energy storage and release apparatus while the apparatus is in use and the apparatus enables adjustment of the secondary energy storage and release apparatus by the user while the apparatus is in use.

It is believed to be understandable from this description that the subject invention meets its objective. It provides apparatus of the subject type in which the forces and associated energy levels involved in the operation of the apparatus can be adjusted by the user while the apparatus is in use.

It will further be understood by those skilled in the art that while a preferred embodiment of the invention is described herein, other embodiments and modifications of the art described are possible within the scope of the invention which is limited only by the attached claims.

What is claimed is:

1. An exercise apparatus comprising a track assembly having a first end and a second end, a carriage for supporting a user in the supine position, means for supporting said carriage in said track whereby said carriage is free to move between said first and second ends, hand grippable means attached to said track assembly whereby said user, by applying hand forces, can set said carriage into reciprocating motion on said track assembly and adjustable energy storage and release means for biasing said carriage toward a position on said track assembly, said apparatus further comprising:

means for enabling adjustment of said energy storage and release means while said apparatus is in use, said adjustable energy storage and release means further comprising:

at least one bungee apparatus attached to said carriage, at least one catch attached to said track assembly and having an engaged condition and a disengaged condition, means for adjusting said at least one catch into said engaged condition, said at least one bungee apparatus being set into engagement with said at least one catch when said at least one catch is adjusted to said engaged condition by said means for enabling adjustment, said carriage and said track assembly having a position for engagement which enables engagement of said at least one catch with said at least one bungee apparatus, said engagement occurring when said at least one catch is adjusted to said engaged condition and said carriage and said track assembly are in said position for engagement, said catch means further comprising means for enabling said engagement to occur when said at least one catch is adjusted to said engaged condition and said carriage moves on said track assembly to put said carriage and said track assembly into said position for engagement.

2. An exercise apparatus comprising a track assembly having a first end and a second end, a carriage for supporting a user in the supine position, means for supporting said carriage in said track whereby said carriage is free to move between said first and second ends, hand grippable means attached to said track assembly whereby said user, by applying hand forces, can set said carriage into reciprocating motion on said track assembly and adjustable energy storage and release means for biasing said carriage toward a position on said track assembly, said apparatus further comprising:

means for enabling adjustment of said energy storage and release means by said user while said apparatus is in use, said adjustable energy storage and release means further comprising:

at least one bungee apparatus attached to said track assembly, at least one catch attached to said carriage and having an engaged condition and a disengaged condition;

means for adjusting said at least one catch into said engaged condition and operating means enabling said user to operate said means for adjusting said at least one catch attached to said carriage, said at least one bungee apparatus being set into engagement with said at least one catch when said at least one catch is adjusted to said engaged condition by said means for adjusting, said carriage and said track assembly having a position range for engagement which enables engagement of said at least one catch with said at least one bungee apparatus attached to said track assembly, said engagement occurring when said at least one catch is adjusted to said engaged condition and said carriage and said track assembly are in said position range for engagement, said catch means further comprising means for enabling said engagement to occur when said at least one catch is adjusted to said engaged condition and said carriage moves on said track assembly to put said carriage and said track assembly into said position range for engagement.

3. The apparatus of claim 1 in which said adjustable energy storage and release means further comprises:

at least one bungee apparatus attached to said track assembly, at least one catch attached to said carriage and having an engaged condition and a disengaged condition, means for adjusting said at least one catch into said engaged condition and operating means enabling said user to operate said means for adjusting said at least one catch attached to said carriage, said at least one bungee apparatus being set into engagement with said at least one catch when said at least one catch is adjusted to said engaged condition by said means for adjusting, said carriage and said track assembly having a position range for engagement which enables engagement of said at least one catch with said at least one bungee apparatus attached to said track assembly, said engagement occurring when said at least one catch is adjusted to said engaged condition and said carriage and said track assembly are in said position range for engagement, said catch means further comprising means for enabling said engagement to occur when said at least one catch is adjusted to said engaged condition and said carriage moves on said track assembly to put said carriage and said track assembly into said position range for engagement.

* * * * *